US008181801B2

(12) United States Patent
Nuotio et al.

(10) Patent No.: US 8,181,801 B2
(45) Date of Patent: May 22, 2012

(54) REAGENT CLOSURE

(75) Inventors: Vesa Nuotio, Espoo (FI); Henrik Johansson, Espoo (FI); Matti Hassinen, Espoo (FI)

(73) Assignee: Thermo Fisher Scientific Oy, Vantaa (FI)

( * ) Notice: Subject to any disclaimer, the term of this patent is extended or adjusted under 35 U.S.C. 154(b) by 0 days.

(21) Appl. No.: 11/905,938

(22) Filed: Oct. 5, 2007

(65) Prior Publication Data

US 2008/0093364 A1 Apr. 24, 2008

(30) Foreign Application Priority Data

Oct. 23, 2006 (FI) ..... 20060933

(51) Int. Cl.
*B65D 43/16* (2006.01)
*B65D 43/26* (2006.01)

(52) U.S. Cl. ..... 215/302; 215/301; 220/229; 220/281; 220/836

(58) Field of Classification Search ..... 220/302, 220/229, 319, 836, 281, 282; 215/301, 302
See application file for complete search history.

(56) References Cited

U.S. PATENT DOCUMENTS

| | | | | |
|---|---|---|---|---|
| 3,987,972 | A | 10/1976 | Gladwin | |
| 5,348,550 | A | 9/1994 | Ikeda et al. | |
| 6,234,363 | B1 | 5/2001 | Stradella | |
| 6,265,225 | B1 | 7/2001 | Otto et al. | |
| 6,269,977 | B1 | 8/2001 | Moore | |
| 6,273,309 | B1 * | 8/2001 | Oppelt | 224/269 |
| 6,656,514 | B1 * | 12/2003 | Tubbs | 426/115 |
| 7,225,949 | B2 | 6/2007 | Kubo et al. | |
| 7,371,355 | B2 * | 5/2008 | Takahashi et al. | 422/102 |
| 7,387,216 | B1 * | 6/2008 | Smith | 220/254.3 |
| 2003/0155321 | A1 * | 8/2003 | Bauer et al. | 215/253 |
| 2004/0067169 | A1 * | 4/2004 | Krause | 422/100 |
| 2004/0222224 | A1 * | 11/2004 | Plester | 220/203.17 |
| 2005/0150888 | A1 * | 7/2005 | Birkmeier | 220/229 |
| 2008/0041851 | A1 * | 2/2008 | Thrapp | 220/229 |

FOREIGN PATENT DOCUMENTS

| | | | |
|---|---|---|---|
| CA | 2 520 921 | A1 | 10/2004 |
| DE | 7425331 | | 11/1974 |
| DE | 4001886 | A1 | 7/1990 |
| EP | 0339729 | A1 | 11/1989 |
| EP | 0 542 295 | A1 | 5/1993 |
| EP | 0 909 584 | A2 | 4/1999 |
| EP | 1 010 635 | B2 | 3/2004 |
| EP | 1 495 747 | A1 | 1/2005 |
| FR | 1135210 | A1 | 4/1957 |
| FR | 2758801 | A1 | 7/1998 |
| JP | 8-313535 | A | 11/1996 |
| JP | 2002-19855 | A | 1/2002 |
| JP | 2004-157020 | A | 6/2004 |
| WO | WO-2004/089805 | A3 | 10/2004 |

* cited by examiner

*Primary Examiner* — Mickey Yu
*Assistant Examiner* — Niki M Eloshway
(74) *Attorney, Agent, or Firm* — Birch, Stewart, Kolasch & Birch, LLP

(57) ABSTRACT

The present invention concerns a closure for mounting on a reagent vessel, the closure including a main body, a top wall attached by its edges to the top edges of the main body, at least one incision dividing the top wall into at least two parts, a flange attached to and extending outwards from the top edge of the top wall, and a hinge area connecting the top edge of the main body to the flange and the top wall.

29 Claims, 2 Drawing Sheets

REAGENT CLOSURE

BACKGROUND OF THE INVENTION

The present invention concerns a closure for mounting on a reagent vessel, the closure comprising a main body comprising a hole to be mounted around the opening of a vessel, such as a reagent container, a top wall attached by its edges to the top edges of the main body and at least one incision dividing the top wall into at least two parts.

In the prior art, reagent containers are generally closed using caps and closures that have been developed in order to keep the contents of the containers uncontaminated or prevent evaporation. Many of the solutions contain piercable septums. Piercing these closures may, however, cause contamination of both dispensers and container contents, since it often is the edge of the dispenser needles that is used for the piercing, whereby the dispenser will come into contact with the closure each time it is used.

EP 0 542 295 concerns a stopper fitted on the mouth of a drug vessel body, which stopper is composed of a stopper body of an elastomeric material and has a hole passing therethrough along its center axis, and a closing body fitted in the hole of said stopper body, said closing body being in the form of a spherical member with a diameter greater than that of said hole, and said closing body being opened just before use using an unpointed end of a separate member for forcing the closing body in the hole to push in the vessel body.

EP 1 010 635 presents a pot-shaped cap comprising a lid portion and a skirt portion to be securely attached to a closed container neck of a drug container, with at least two puncture openings being provided in the lid portion of the cap, and a seal, which is made of an elastic material and covers the puncture openings, being located in the lid portion, said seal being inserted in a chamber integrally formed with the lid portion, said chamber protruding outwardly over the outside of the lid portion and said seal being disk-shaped.

JP 8313535 presents a plug body mounted on the mouth section of a container, which plug body contains a hole for passing a pipette meant to suck up a reagent from the reagent container and discharge it into a reaction container.

JP 2004157020 concerns a reagent container comprising a cap that is fitted to the opening of the container and that is made of an elastic material. The cap has a cross-like cut, which can be deformed by pressing and inserting a guide pipe into the cut from the outside.

Another type of closures essentially consists of two structures, one of which being the skirt that surrounds the opening of the vessel, keeping the closure in place, the other structure forming the lid, covering the opening of the vessel and being attached to the first structure by a spring. These types of closures have the disadvantage of requiring much free space around the vessel when being opened to allow the entire lid structure to move in the required direction.

EP 0 909 584 describes a cap for a reagent container, which is provided with a scalable lid, which lid van be pivoted laterally upward from the cap sealing position, with the container being opened, by means of an inclined bistable hinge, and which lid bears one or more catches, which can come into contact with an apparatus for opening or closing the lid.

A further type of closures contains a complex combination of elements meant to prevent evaporation, leakage of liquids and contamination.

CA 2 520 921 describes a dispensing assembly to be coupled to a vessel, the assembly containing a tip that includes a valve to allow drop-wise liquid dispensing, a vent opening, a filtration element and an antibacterial liner enabling the solution in the vessel to remain sterile.

U.S. Pat. No. 6,269,977 concerns a container cover consisting of a single molded disc shaped device with an elevated flat surface functioning as a platform for supporting another container thereon.

JP 2002019855 describes an adapter for preventing the liquid in a container from coming into contact with air, the adapter containing an opened upper part and a closed bottom part, the bottom further including a cut from which the liquid carp can be separately taken.

EP 1 495 747 presents a liquid drug container with a nozzle member and a nozzle cap, wherein the nozzle hole of the nozzle member is covered with a hydrophilic filter, and a top wall of the nozzle member is provided with an air hole covered with a hydrophobic filter.

The disadvantages of conventional closures include that in order to provide a solution that prevents evaporation and contamination, a very complex closure with several separate components is used. These complex solutions still do not focus on preventing contamination caused by contact between the closure and the dispenser, only between the inside of the vessel and the environment. The solutions of the prior art also fail in providing vessel closures that allow the dispensing devices to function without ever touching the vessels or the closures.

SUMMARY OF THE INVENTION

An aim of the separate embodiments of the present invention is to provide a closure for reagent vessels that prevents evaporation of the reagent and does not contaminate the tip or needle of the dispensing device.

Another aim of the embodiments is to provide a closure that is easily opened, is closed automatically and can be opened outwards, whereby it provides a large free area at the opening of the vessel.

A further aim of the embodiments of the invention is to provide a closure that does not break the dispenser needle if the closure unintentionally remains closed and does not require a large free area around the opening of the vessel.

A further aim of the embodiments is to provide a closure that is easily mounted on the neck of the vessel and fits vessels of different sizes.

The present invention concerns a closure for mounting on a reagent vessel, the closure comprising

- a main body comprising a hole to be mounted around the opening of a vessel, such as a reagent container,
- a top wall attached by its edges to the top edges of the main body, and
- at least one incision dividing the top wall into at least two parts.

The closure of the present invention is characterized by a flange attached to and extending outwards from the top edge of the top wall, and by a hinge area connecting the top edge of the main body to the flange and the top wall.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The advantages reached using the present invention include achieving a simple closure structure that minimizes contamination, prevents evaporation and is easily mounted on various vessels. Further, the closure is reusable.

Figure 1:
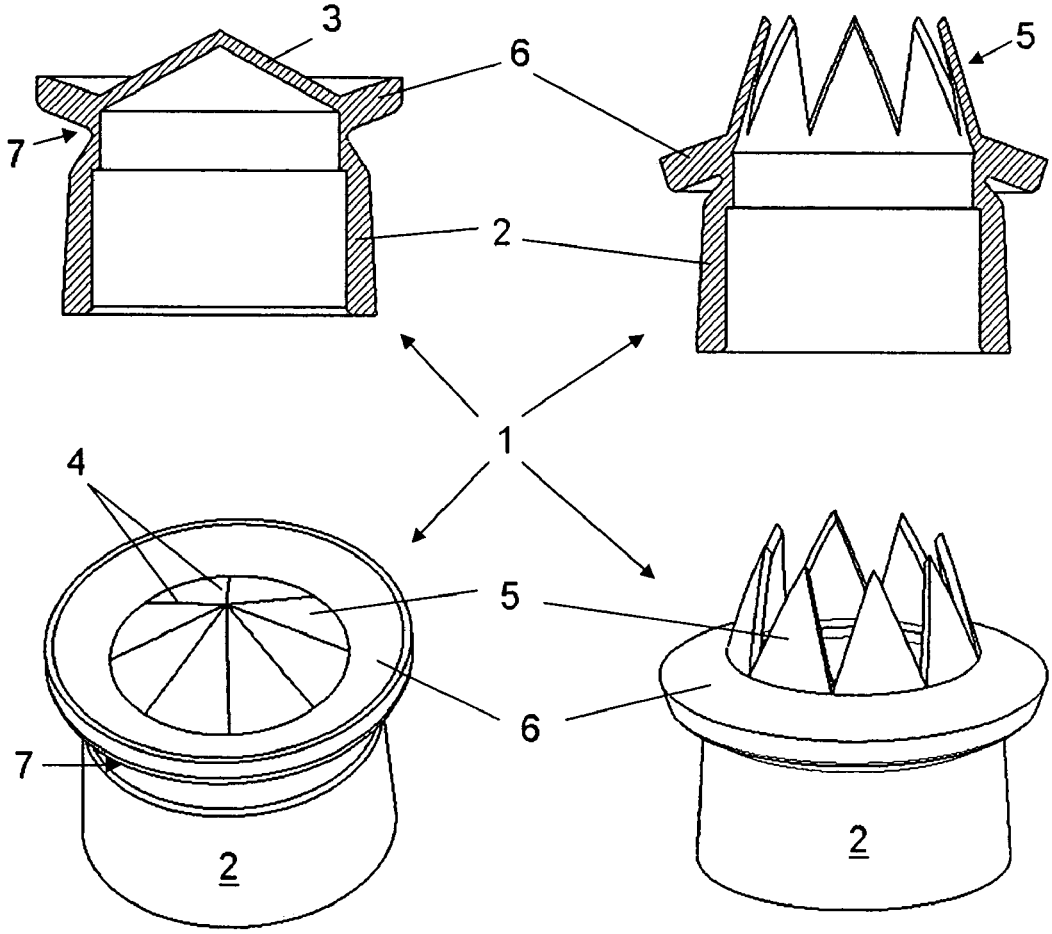
FIG. 1 shows the closure viewed from different angles.

A preferred closure of the present invention is shown in FIG. 1.

The closure 1 which can be threaded or unthreaded and is preferably manufactured from an elastomer comprises a main body 2 forming a skirt around the neck of the vessel onto which the closure 1 is to be mounted and a top wall 3 attached to the top edge of the skirt forming the lid section of the closure 1. Because at least one incision 4 is cut into the top wall 3, the wall 3 is shaped as flaps 5. Below the top wall, a distal flange 6 is attached to the top edge of the main body 2, the main body 2 also containing a hinge area 7 for surrounding the neck of the vessel to which the closure is to be attached, which area preferably forms a groove that functions as a hinge when pressing the flange 6 at its top edge in the downward direction.

The main body 2 of the closure 1 essentially has the shape of a cylinder or a prism with 3-10 faces, preferably 3-5 faces. The shape is chosen in accordance with the shape of the neck of the reagent vessel on which the closure 1 is to be mounted.

The top wall 3 may either be a planar surface positioned at an essentially 90° angle to the main body 2 or it may have the shape of a cone or of a pyramid with 3-10 faces, preferably 3-5 faces.

According to an embodiment of the present invention, the tip of the conical or pyramidal top wall 3 extends in towards the opening of the vessel, making the angle between the main body 2 and the top wall about 60-90°, preferably about 75°.

According to a preferred embodiment of the present invention, the tip of the conical or pyramidal top wall 3 extends away from the opening of the vessel, making the angle between the main body 2 and the top wall 3 about 90-130°, preferably about 120°.

The shape of the top wall 3, with the tip protruding upwards, has the advantage of causing contaminants to slide down towards the distal edge of the top wall 3 instead of towards the center, which is the area where the closure 1 opens up.

The entire closure 1 of the present invention with the tip protruding upwards preferably has a distance from the bottom edge of the main body 2 to the outer surface of the tip of the top wall 3 of 15-25 mm, more preferably 17-19 mm. The distance from the bottom edge of the main body 2 to the inner surface of the tip of the top wall is preferably about 1 mm less than the distance to the outer surface of the tip.

The distance from the bottom edge of the main body 2 to the distal edge of the top wall 3, measured to the outer surface of the distal edge, is preferably about 11-20 mm, more preferably about 13-14.5 mm, whereas the same distance, measured to the inner surface of the distal edge, is about 0.5-1.5 mm less.

The incision 4 divides the top wall 3 into at least two parts and may extend across the top wall 3 from one edge to another. Alternatively, the incision 4 can extend across the top wall 3 from one edge of the flange 6 to another. In the case of only one incision 4, the incision preferably crosses the center of the top wall 3, dividing the top wall 3 and optionally the flange 6 into two crescent-shaped parts.

According to a particularly preferred embodiment of the present invention, there are at least three radial incisions 4 intersecting at the center of the top wall 3 to form at least three pie-shaped flaps 5. Preferably the amount of flaps is 3-12, more preferably 4-10 and most preferably 6-8. A smaller amount of incisions 4 or flaps 5 will reduce the diameter of the opening of the closure 1 in the opened position. Increasing the amount of incisions to three or more will again will increase the diameter of the opening, thereby giving a larger free space at the opening of the vessel. The incisions can either cut both the top wall 3 and the flange 6 into pie-shaped flaps 5 or leave the flange 6 intact.

The flange 6 is preferably shaped as a continuous annular flange 6 structure that extends all the way around the top wall 3. When the flange 6 is pressed down, the flaps 5 on the top wall 3 of the closure 1 are turned upwards, whereby the closure 1 is opened, forming a hole in the center of the closure 1. Thus, as mentioned above, the closure 1 is preferably opened outwards, i.e. away from the opening of the vessel, which has the further advantage of not reducing the inner diameter of the opening of the vessel. Further, the flange 6 of the closure 1 functions as a spring that brings the flaps 5 down to their original position, i.e. closes the closure 1, when the pressure is removed from the flange 6.

The main body 2 of the closure has an outer diameter of 17-25 mm, preferably 20-21 mm, and an inner diameter of 15-17.5 mm, preferably 16-17 mm, with the diameters of the bottom part preferably about 1-2 mm longer than those of the top part, making the closure 1 more easy to mount on vessels.

The hinge area 7 on the top edge of the main body 2 preferably has an outer diameter of 15-21 mm, more preferably about 17-17.5 mm, and an inner diameter of 14-20 mm, more preferably about 15.5-16.5 mm. The thickness of the closure 1 material at the main body 2 section is 1.5-3 mm, preferably about 2 mm, and the thickness at the thinnest section of the hinge area 7 groove is 0.35-1.5 mm.

The distance from the bottom edge of the main body 2 to the thinnest section of the hinge area 7 of the main body 2 is preferably about 9-18 mm, more preferably about 10.5-12.0 mm, whereas the distance from the bottom edge of the main body 2 to the bottom edge of the hinge area 7 preferably is about 7-16 mm, more preferably about 8.5-10 mm.

Without a specific hinge area 7 that is thinner than the rest of the material of the main body 2, the process of pressing down the flange 6, and thus opening the closure 1, would require a greater force than in the case of the present invention, since a greater thickness of this hinge would give the flange 6 a more restricted flexibility. Further, the hinge area 7 causes the material to bend at a specific area, i.e. at the joint between the main body 2 and the flange 6. Without the hinge area 7, pressing down the flange 6 could cause the whole closure 1 structure, or at least the upper half of the main body 2 structure, to bend or cave in.

The diameter of the top wall 3 is essentially the same as the inner diameter of the hinge area 7 of the main body 2, whereas the thickness of the material forming the top wall 3 is about 0.5-3 mm, preferably about 0.7-1 mm.

The flange 6 of the closure 1 preferably has an outer diameter of 22-28 mm, more preferably 24-25 mm, whereas the inner diameter of the flange 6 is the same as the diameter of the top wall 3, since the flange 6 and the top wall 3 are connected through that point. The thickness of the material forming the flange 6 is preferably 0.7-5 mm, more preferably 1.5-3 mm.

According to one embodiment of the present invention, the flange 6 and the main body 2 are positioned at an essentially 90° angle to each other.

According to another embodiment of the present invention, the flange 6 slopes slightly downwards, preferably 1-20°, more preferably 2-10°.

According to a preferred embodiment of the present invention, the flange 6 slopes slightly upwards from the center, preferably 10-30°, more preferably about 20°.

An advantage of the last mentioned preferred embodiment over the other ones, is that the process of pressing down the flange 6, thus opening the closure 1, will provide a larger hole and a straighter and simpler path of motion, whereas an advantage of the second mentioned embodiment over the preferred one is that contaminants dripping or falling onto the top wall 3 will slide down over the edge of the flange 6 of the closure 1 instead of being caught in the v-shaped pit between the downwards sloping flap 5 of the top wall 3 and the upwards sloping flange 6.

According to one embodiment of the present invention, the hinge area 7 is manufactured from an elastomer, thereby providing the required flexibility of a hinge, whereas the other parts of the closure 1 may all independently be manufactured from either the same elastomer or a less elastic polymeric material.

According to a preferred aspect of this embodiment, both the hinge area 7 and the rest of the main body 2 of the closure 1 are manufactured from an elastomer, the main body 2 thereby providing the elasticity required to make the closure 1 easily fit vessels of different sizes and remain steadily mounted on them even without threading of the main body 2, whereas the other parts of the closure 1 may all independently be manufactured from either the same elastomer or a less elastic polymeric material.

According to a particularly preferred embodiment of the present invention, the entire closure 1, including the flange 6, is preferably manufactured from the same material, i.e. an elastomer, preferably a silicone.

The term "elastomer" refers to an amorphous cross-linked elastic polymer existing above its glass transition temperature ($T_g$) making it soft and deformable. It has high tensile strength and high modulus when fully stretched. On the release of stress it will retract rapidly to recover its original dimensions.

Elastomers are unlike conventional thermoplastics in that they can be repeatedly softened and hardened by heating and cooling without substantial change in properties. Primarily elastomers are used to manufacture seals, adhesives and other molded flexible parts.

Examples of elastomers that can be used to manufacture the closure of the present invention include natural rubber, various synthetic rubbers and silicones as well as other elastic polymers or copolymers.

The closure 1 of the present invention is not intended to completely prevent evaporation of the reagent in the reagent vessel. A complete prevention of evaporation would cause a pressure difference between the inside of the vessel and the ambient air. This could cause some of the reagent to spurt out of the vessel when opening the closure 1. However, the closure 1 of the present invention minimizes evaporation sufficiently to prevent a reduction of the volume of the reagent while also preventing a pressure difference from forming between the inside of the vessel and the ambient air.

Figure 2:
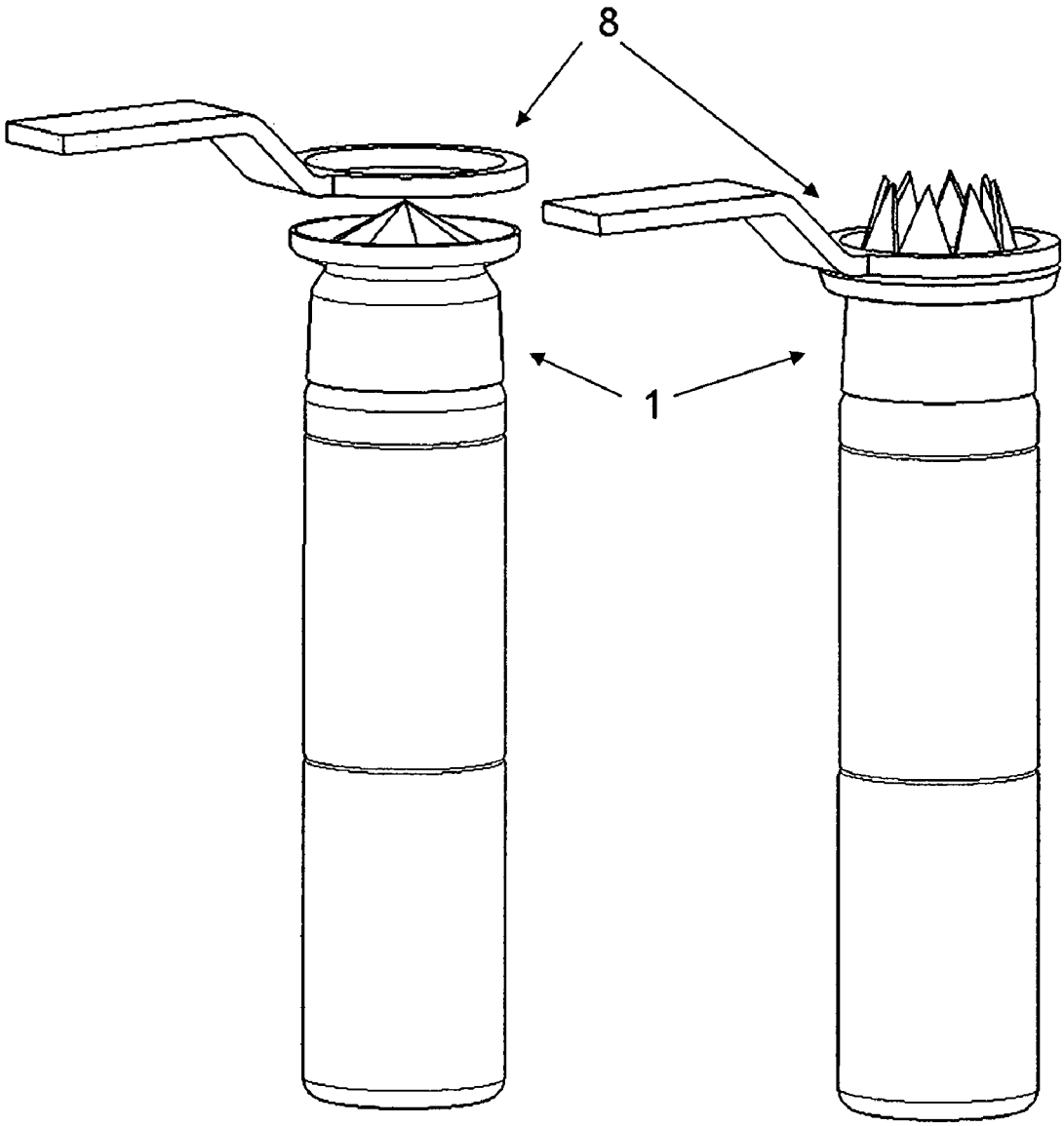
FIG. 2 is a picture of the closure mounted on a reagent container, being opened using a separate actuator ring.

According to the present invention, the closure 1 is opened using a process, wherein a ring-shaped actuator 8, manufactured from any rigid material, is pressed downwards against the flange 6 that extends outwards from the top edge of the top wall 3 of the closure 1 (FIG. 2). Preferably the actuator 8 is decoupled from the dispenser device. This actuator 8 has essentially the same inner and outer diameter as the flange 6. However, the inner diameter of the actuator 8 is maintained at value that is 0.1-2 mm higher than the value for the diameter of the joint between the conical top wall 3 and the flange 6. This clears the area the flaps 5 of the top wall 3 require when the closure 1 is opened and makes the process of opening the closure 1 easier and more effective. It also minimizes the risk of contamination of the vessel contents caused by the actuator 8.

Once the actuator 8 has been used to press down the flange 6, thereby pressing the flaps 5 of the top wall 3 upwards and opening the closure 1, the contents of the reagent vessel can be reached through the actuator ring 8 and through the opening at the center of the closure 1 using, for example, a dispensing device.

After the dispensing, the actuator 8 is released, whereby the flange 6 and the flaps 5 of the top wall 3 automatically return to their original positions due to the elasticity of at least the material of the hinge that the hinge area 7 of the main body 2 forms.

The separate embodiments of the present invention provide a closure for reagent vessels that

- is completely manufactured from one single material,
- prevents evaporation of the reagent,
- is easily opened,
- is closed automatically when releasing the pressure from the flange,
- can be opened outwards, whereby it provides a large free area at the opening of the vessel,
- does not contaminate the needle of the dispenser,
- does not break the dispenser needle if the closure remains unopened,
- does not require a large free area around the opening of the vessel,
- is easily mounted on the opening of the vessel, and
- fits vessels of different sizes.

The invention claimed is:

1. A closure for mounting on a reagent vessel which comprises:

- a main body containing an aperture adapted for mounting around the opening of said reagent vessel,
- a top wall attached to top edges of the main body and extending away from the opening of the reagent vessel,
- at least one incision dividing the top wall into at least two segments,
- a flange attached to and extending outwards from the top edge of the top wall distally from the center of the closure, and
- a hinge area connecting the top edge of the main body to the flange and the top wall, wherein said flange slopes upwardly at an angle of 10-30°.

2. The closure of claim 1, wherein the main body has the shape of a cylinder or a prism with 3-10 faces.

3. The closure of claim 2, wherein the top wall essentially has the shape of a cone or a pyramid with 3-10 faces.

4. The closure of claim 2, wherein there are at least three incisions intersecting at the center of the top wall to form at least three pie-shaped segments.

5. The closure of claim 1, wherein the top wall has the shape of a cone or a pyramid with 3-10 faces.

6. The closure of claim 5, wherein the tip of the cone shaped or pyramid shaped top wall extends away from the opening of the vessel with the tip protruding upwards.

7. The closure of claim 6, wherein there are at least three incisions intersecting at the center of the top wall to form at least three pie-shaped segments.

8. The closure of claim 5, wherein there are at least three incisions intersecting at the center of the top wall to form at least three pie-shaped segments.

9. The closure of claim 1, wherein the at least one incision extends across the top wall from one edge thereof to the other.

10. The closure of claim 1, wherein the at least one incision extends across the top wall from one edge of the flange to the other.

11. The closure of claim 1, wherein there are at least three incisions intersecting at the center of the top wall to form at least three pie-shaped flaps.

12. The closure of claim 1, wherein the thickness of the closure hinge area is 0.5-1.5 mm and the thickness of the closure remaining parts of the main body is 1.5-3 mm.

13. The closure of claim 1, having a single construction piece and made from an elastomer.

14. The closure of claim 1, wherein the main body has an outer diameter of 17-25 mm, an inner diameter of 15.5-23 mm, with the diameter of a bottom part being about 1-2 mm longer than that of a top part.

15. A closure for mounting on a reagent vessel which comprises:

a main body containing an aperture adapted for mounting around the opening of said reagent vessel, a top wall attached to top edges of the main body and extending away from the opening of the reagent vessel, at least one incision dividing the top wall into at least two segments, a flange attached to and extending outwards from the top edge of the top wall distally from the center of the closure, and a hinge area connecting the top edge of the main body to the flange and the top wall, wherein said flange slopes downward at an angle of 1-20°.

16. A closure for mounting on a reagent vessel which comprises:

a main body containing an aperture adapted for mounting around the opening of said reagent vessel, a top wall attached to top edges of the main body and extending away from the opening of the reagent vessel, at least one incision dividing the top wall into at least two segments, a flange attached to and extending outwards from the top edge of the top wall distally from the center of the closure, said flange and said main body being positioned at essentially a 90° angle towards each other, and a hinge area connecting the top edge of the main body to the flange and the top wall, wherein the closure is opened by depressing the flange, whereby the segments are opened outwardly, away from the reagent vessel.

17. The closure of claim 16, wherein the main body has the shape of a cylinder or a prism with 3-10 faces.

18. The closure of claim 16, wherein the top wall has the shape of a cone or a pyramid with 3-10 faces.

19. The closure of claim 16, wherein the tip of the cone shaped or pyramid shaped top wall extends away from the opening of the vessel with the tip protruding upwards.

20. The closure of claim 16, wherein the at least one incision extends across the top wall from one edge thereof to the other.

21. The closure of claim 16, wherein the at least one incision extends across the top wall from one edge of the flange to the other.

22. The closure of claim 16, wherein there are at least three incisions intersecting at the center of the top wall to form at least three pie-shaped flaps.

23. The closure of claim 16, wherein the thickness of the closure hinge area is 0.5-1.5 mm and the thickness of the closure remaining parts of the main body is 1.5 -3 mm.

24. The closure of claim 16, having a single construction piece and made from an elastomer.

25. The closure of claim 16, wherein the main body has an outer diameter of 17-25 mm, an inner diameter of 15.5-23 mm, with the diameter of a bottom part being about 1-2 mm longer than that of a top part.

26. The closure of claim 16, wherein the top wall essentially has the shape of a cone or a pyramid with 3-10 faces.

27. The closure of claim 16, wherein there are at least three incisions intersecting at the center of the top wall to form at least three pie-shaped segments.

28. The closure of claim 16, wherein there are at least three incisions intersecting at the center of the top wall to form at least three pie-shaped segments.

29. The closure of claim 16, wherein there are at least three incisions intersecting at the center of the top wall to form at least three pie-shaped segments.

* * * * *